US009506727B2

(12) United States Patent
Bertolini

(10) Patent No.: US 9,506,727 B2
(45) Date of Patent: Nov. 29, 2016

(54) ARMOURED WINDOW CONSTRUCTION

(71) Applicant: Isoclima S.p.A., Este (IT)

(72) Inventor: Alberto Bertolini, Este (IT)

(73) Assignee: ISOCLIMA S.P.A., Este (IT)

( * ) Notice: Subject to any disclaimer, the term of this patent is extended or adjusted under 35 U.S.C. 154(b) by 163 days.

(21) Appl. No.: 13/778,225

(22) Filed: Feb. 27, 2013

(65) Prior Publication Data

US 2014/0144313 A1 May 29, 2014

(30) Foreign Application Priority Data

Nov. 29, 2012 (EP) ..... 12425190

(51) Int. Cl.
*F41H 7/04* (2006.01)
*F41H 5/26* (2006.01)

(52) U.S. Cl.
CPC ..... *F41H 7/04* (2013.01); *F41H 5/263* (2013.01)

(58) Field of Classification Search
CPC ..... F41H 5/26; F41H 5/263; F41H 5/04; F41H 5/0407; F41H 7/04; F41H 7/00; F41H 5/013
USPC ..... 89/36.01, 36.07–36.08, 905, 918
See application file for complete search history.

(56) References Cited

U.S. PATENT DOCUMENTS

| | | | | |
|---|---|---|---|---|
| 2,356,878 | A * | 8/1944 | Painter | 52/208 |
| 2,784,926 | A * | 3/1957 | Bonza et al. | 244/129.3 |
| 6,129,974 | A | 10/2000 | Woell | |
| 6,276,100 | B1 * | 8/2001 | Woll et al. | 52/204.62 |
| 6,569,787 | B1 * | 5/2003 | Snelling | 442/135 |
| 6,708,595 | B1 * | 3/2004 | Chaussade et al. | 89/36.02 |
| 6,818,268 | B2 * | 11/2004 | Gonzalez | 428/34 |
| 7,437,856 | B2 * | 10/2008 | Berger, Jr. | 52/208 |
| 7,908,958 | B2 * | 3/2011 | Mandelartz et al. | 89/36.02 |
| 2008/0032104 | A1 * | 2/2008 | Mannheim Astete et al. | 428/215 |
| 2008/0187721 | A1 * | 8/2008 | Engl | 428/172 |
| 2012/0175908 | A1 * | 7/2012 | McCarthy et al. | 296/84.1 |

FOREIGN PATENT DOCUMENTS

| | | | |
|---|---|---|---|
| DE | 10043026 | A1 | 3/2002 |
| DE | 10340907 | A1 | 4/2005 |
| DE | 102007060062 | A1 | 6/2009 |
| DE | 202011001371 | U1 | 4/2011 |
| DE | 102010020560 | A1 | 11/2011 |
| EP | 0915315 | A2 | 5/1999 |
| WO | 2012095098 | A1 | 9/2012 |

OTHER PUBLICATIONS

Translation of DE10340907, WIPO, pp. 1-3.*

* cited by examiner

*Primary Examiner* — Stephen M Johnson
*Assistant Examiner* — Benjamin Gomberg
(74) *Attorney, Agent, or Firm* — Hauptman Ham, LLP

(57) ABSTRACT

An armored window construction for a window opening of a body of a vehicle includes a bullet resistant pane, an armored inner frame arranged inside of the vehicle and overlapping at least part of a peripheral area of the bullet resistant pane, and a mounting frame for mounting the inner frame on the bullet resistant pane. The mounting frame is arranged within a peripheral step of the bullet resistant pane. The mounting frame includes a first part fixed on an inner surface of an outer glass pane of the bullet resistant pane within the peripheral step, and mounting protrusions protruding from the first part. The inner frame is fixed on the mounting protrusions. The first part of the mounting frame is pressed against a lowered window rabbet on an outside surface of the body of the vehicle.

21 Claims, 3 Drawing Sheets

ARMOURED WINDOW CONSTRUCTION

RELATED APPLICATIONS

The present application is based on, and claims priority from, Europe Application Number 12425190.1, filed Nov. 29, 2012, the disclosure of which is hereby incorporated by reference herein in its entirety.

BACKGROUND

The invention relates to an armoured window construction to be arranged in a window opening of a body of a vehicle or car, wherein the window construction comprises a bullet resistant pane means mounted on an outside of the body of the vehicle and arranged within the window opening.

EP 0 915 315 B1 describes a known bullet proof glazing that is a multilayered laminate comprising several panes of glass with adhesive foil layers arranged between them, and also an armoured metallic edge insert for reinforcing and protecting a peripheral area or edge of the glazing against bullets impinging on the outside of the vehicle at the edge of the armoured window. The integrated insert is arranged on an outside surface of the vehicle body or window rabbet or folding. But in many cases, for instance, if a usual window should be replaced by a bullet proof or armoured window for protecting the passengers inside the vehicle or car there is not enough space to arrange the edge reinforcement in the window rabbet.

SUMMARY

It is, therefore, an object of the present invention to provide an armoured window construction that can be used in all vehicle bodies, even with only small or limited window rabbets.

This object is solved by the armoured window construction of the invention to be arranged in a window opening of a body of a vehicle or car, and comprising bullet resistant pane means or a bullet resistant glazing mounted on an outside of the body of the vehicle and arranged within the window opening. Further, the window construction of the invention has an armoured inner frame that is arranged inside of the vehicle and overlaps at least part of a peripheral area of the pane means, and mounting means for mounting the inner frame on the pane means.

The window construction of the invention can be installed in the window opening formed in the body of a vehicle or car, even the dimensions of the original window rabbet are too small to receive the glass and a bullet resistant reinforcement together since the pane or glazing of the window construction of the invention is installed on the outside of the vehicle whereas its armoured inner frame or reinforcement is arranged and installed from the inside of the vehicle on the glazing by help of mounting means or a mount. Accordingly, it is the remarkable advantage of the window of the invention that it can be easily installed in an original window rabbet without requiring complex changes of the design or body of the vehicle. The invention also enables the replacement of original usual glass pane or glazings by bullet proof glazings if a bullet resistant car is equipped.

Since the window construction of the invention comprises the armoured inner frame as reinforcement of a peripheral edge area of the armoured window, it provides increased protection against bullets fired on the edge of the bullet resistant window.

Preferably, the bullet resistant pane means has a circumferential pane protrusion, in most cases provided by an outer glass pane or glass sheet of the pane means, at its edge for forming an edge step of the pane means to enable mounting of the window in the window rabbet, wherein the armoured inner frame overlaps at least a part of the step of the bullet proof pane means or glazing to ensure protection also at the edge of the pane.

As required, the armoured inner frame overlaps the step and the pane protrusion at least partly to ensure desired protection against bullets also at the edge of the window. According to this feature, the inner frame can also be designed such that the whole step or protrusion of the bullet resistant pane is completely covered or overlapped by the inner frame or that the inner frame even protrudes the protrusion of the pane or even further a step edge of an inner pane or layer of the pane means.

The pane means can be formed from a single bullet proof pane or sheet or, preferably, it is a layered laminate comprising several panes or sheets made of glass or other appropriate materials like polycarbonate, plastic, or hard polyurethane, and adhesive layers or foils made of, for instance, polyvinylbutyral or polyurethane in order to ensure the desired protection.

Preferably, the mounting means of the invention can comprise a circumferential or segmented mounting frame arranged on the peripheral area of the pane means to ensure fixing of the armoured inner frame on the window pane. The mounting frame can have a L-shape or Z-shape or any other shape in cross section or design as required by the design of the window rabbet or body of the vehicle.

Preferably, the mounting frame is arranged within a step of the pane means or bullet resistant glazing to reinforce the step area additionally. The mounting frame is fixed to the pane means by gluing or an adhesive foil to ensure secure fixing of the mounting frame on the pane.

The armoured inner circumferential frame can be fixed to the mounting frame by, for instance, screwing to enable easy replacement of a damaged glass pane.

Preferably, the mounting frame comprises mounting protrusions protruding from the mounting frame to inside of the vehicle through its window opening and being fixed on the mounting frame, wherein the inner frame is fixed on the mounting protrusions to enable screwing of the inner frame on the mounting frame.

The mounting protrusions can be arranged equidistantly on a circumferential peripheral line on the mounting frame and the inner frame cam be fixed on the mounting protrusions by means of respective screw joints to ensure a secure attachment of the inner frame on the pane.

Preferably, the armoured inner frame extends in a circumferential manner to provide protection without gap or interruption along the periphery of the pane. The armoured inner frame can comprise several parts with overlapping adjoining ends to enable a modular structure of the inner frame.

The armoured inner frame can be mounted by rubber means on an inner surface of the pane means or on the inside of the body of the vehicle to reduce or avoid its oscillations. The rubber means can cover an edge of the armoured inner frame.

Preferably, the bullet resistant pane means is mounted on the vehicle body by means of an adhesive bead, and further also the armoured inner frame is mounted on an inner surface of the pane means or on an inner surface of the vehicle body by adhesive bead.

Further advantageous embodiments, advantages, and features of the invention are mentioned in the following description of a preferred and exemplified embodiment of the invention in connection with the drawings that show:

DETAILED DESCRIPTION

Figure 1:
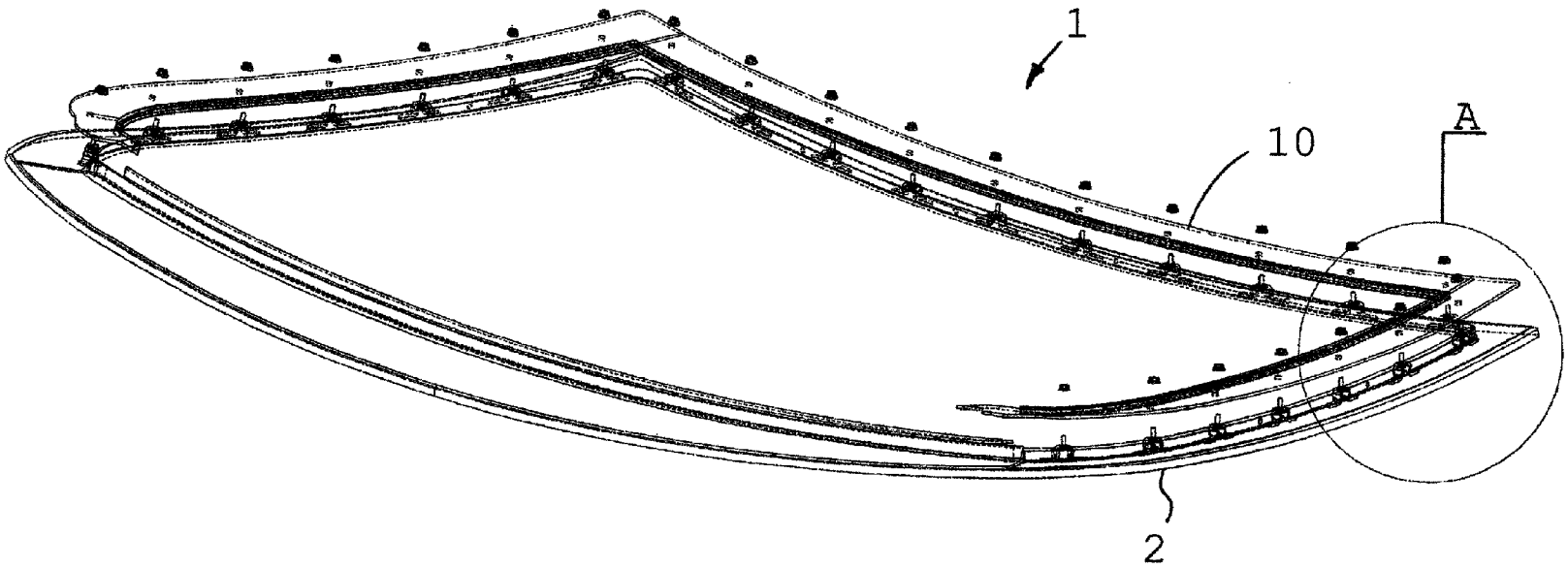
FIG. 1 a perspective view in partly exploded manner of a preferred embodiment of an armoured window construction of the invention.
Figure 2:
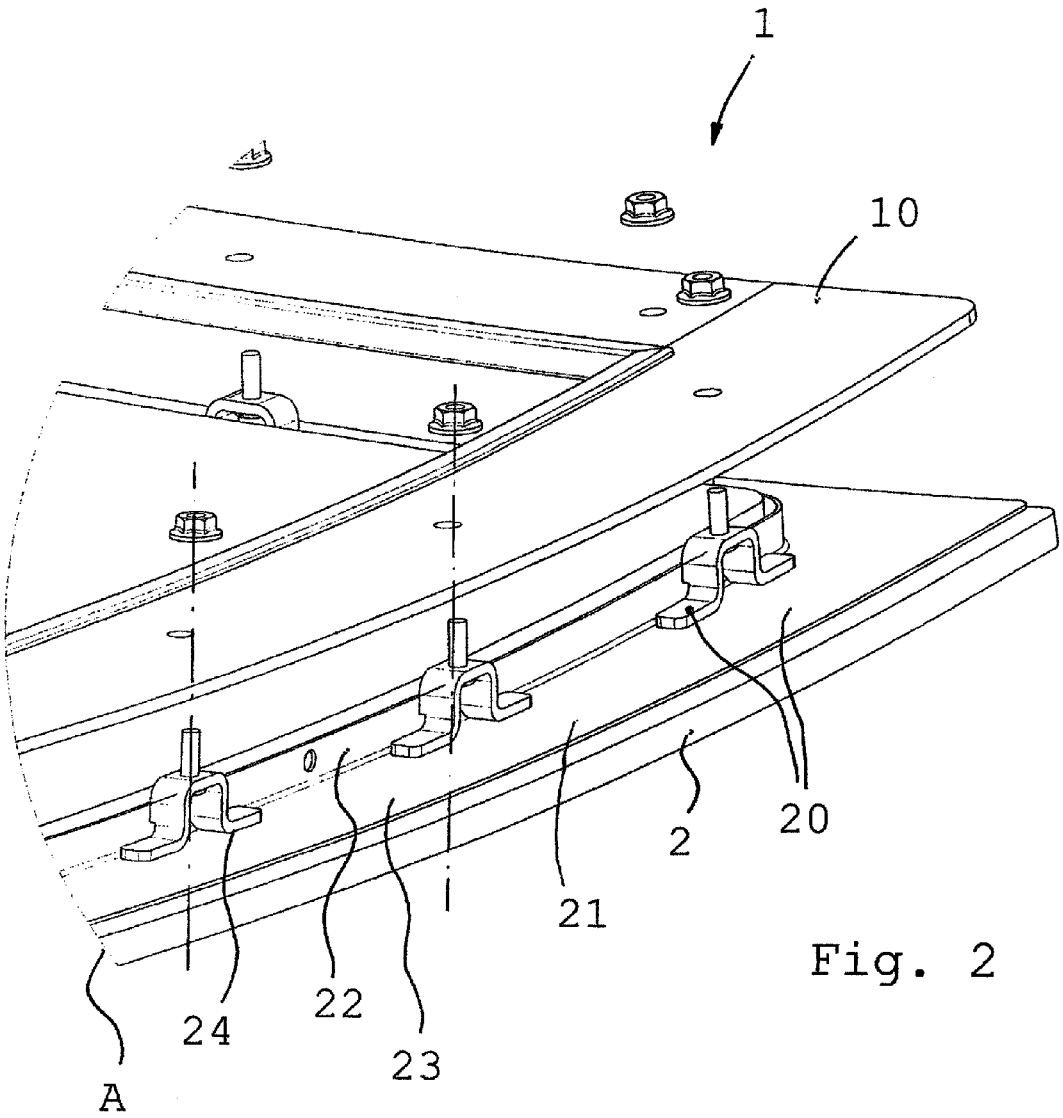
FIG. 2 a detailed exploded view of a corner portion of the window of FIG. 1 marked A in FIG. 1.
Figure 3:
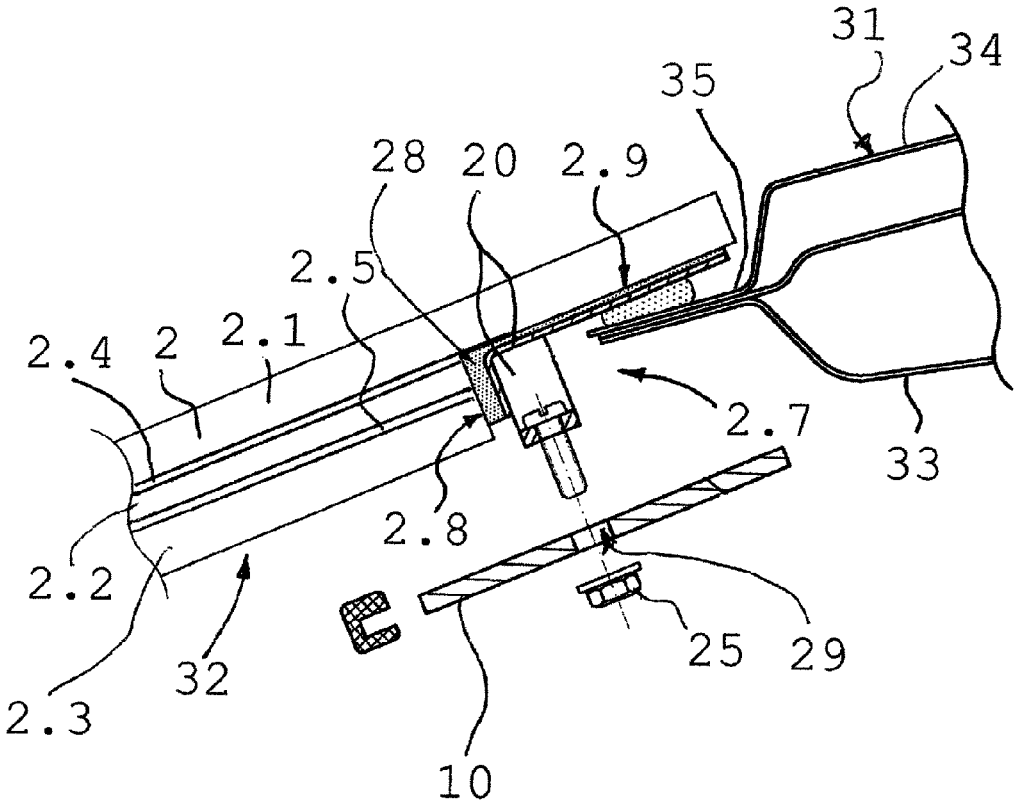
FIG. 3 a schematic cross section view in exploded manner of the armoured window construction according to FIGS. 1 and 2 within a window opening of a car on the body of the car or window rabbet prepared for screwing.
Figure 4:
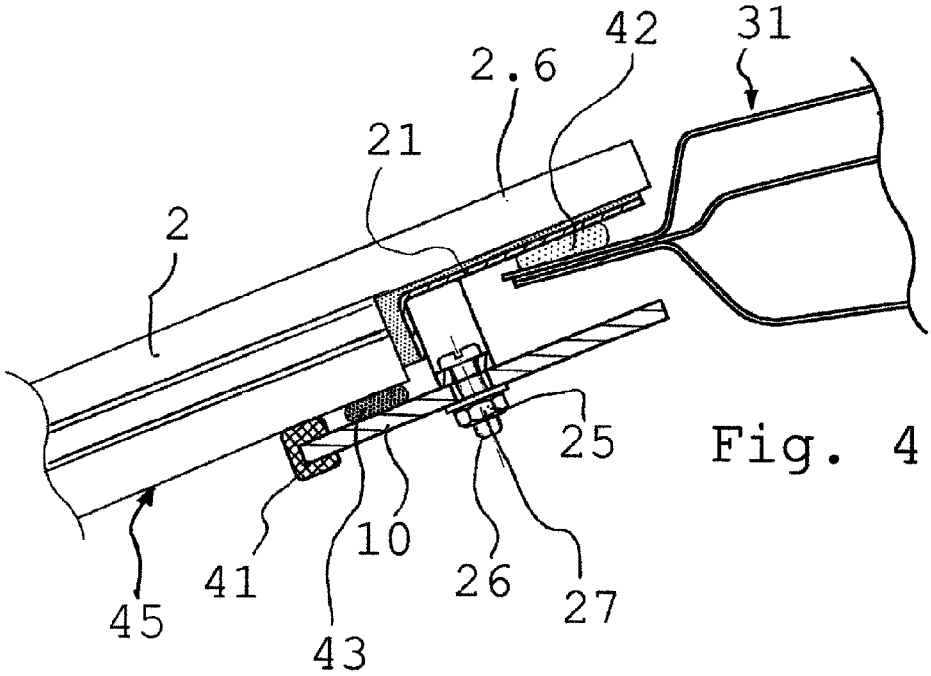
FIG. 4 a schematic cross section view corresponding to FIG. 3, but readily screwed.

FIG. 1 and FIG. 2 show a perspective view in partly exploded manner of a preferred embodiment of an armoured window construction 1 of the invention which can be arranged and installed in a window opening 32 of a body 31 or metallic structure of a vehicle or car as shown in FIG. 3 and FIG. 4.

The armoured window construction 1 comprises bullet resistant pane means 2 or glazing mounted on an outside 34 of the body 31 of the vehicle and arranged within the window opening 32, an armoured inner frame 10 or armoured plate arranged inside of the vehicle and overlapping at least part of a peripheral area of the pane means 2, and mounting means 20 for mounting the armoured inner frame 10 on the pane means 2.

The bullet resistant pane means 2 is formed as a layered laminate that comprises, for instance, an outer glass pane 2.1, an inner glass pane 2.3 or inner pane made of poly carbonate (PC), plastic or hard polyurethane, and a middle glass pane 2.2 arranged between the outer glass pane 2.1 and the inner glass pane 2.3. An interlayer 2.4 made of polyvinylbutyral (PVB) or an adhesive foil is arranged between the inner glass pane 2.1 and the middle glass pane 2.2. A further interlayer 2.5 made of polyvinylbutyral (PVB) or an adhesive foil is arranged between the middle glass pane 2.2 and the inner glass pane 2.3. The outer glass pane 2.1 has a circumferential pane protrusion 2.6 that protrudes the other glass panes 2.2 and 2.3 at a peripheral circumferential edge of the pane means 2. The protrusion 2.6 effects a step 2.7 at the edge of the pane means 2, the step 2.7 comprising an inner circumferential surface 2.9 of the outer glass pane 2.1 and a circumferential face 2.8 formed substantially by the middle glass pane 2.2 and the inner glass pane 2.3 that are flush at their edges. The inner surface 2.9 is normal to the face 2.8. Each of the panes 2.1, 2.2, and 2.3 can be made of glass, poly carbonate (PC), plastic, or hard polyurethane.

The mounting means 20 comprises a circumferential mounting frame 21, a plurality of mounting protrusions 24, and a corresponding plurality of screw connections 25 each comprising a threaded screw pin 26 and a corresponding screw nut 27.

The mounting frame 21 of the mounting means 20 is arranged in circumferential manner within the step 2.7 of the pane means 2 and it comprises a L-shape cross section with a first part 23 and a second part 22 that is normal to the first part 23. The first part 23 is fixed on the inner surface 2.9 of outer glass pane 2.1 within the step 2.7 by gluing 28 or an adhesive foil made, for instance, of polyurethane, whereas its second part 22 is fixed on the face 2.8 within the step 2.7 again by the gluing 28 or an adhesive foil made, for instance, of polyurethane. The mounting frame 21 is made of thin sheet metal and can be integral or segmented. The mounting frame 21 covers substantially the whole inner surface 2.9 of the outer glass pane 2.1 and the whole face 2.8 within the step 2.7 of the bullet resistant pane 2. The mounting frame can be made in alternative of composite fiber or plastic.

The mounting protrusions 24 or appendices are fixed to the mounting frame 21 by, for instance, welding and adjoin the first and second parts 23, 22 in a corner formed by them. The mounting protrusions 24 are equidistantly arranged along a circumferential line. The mounting protrusions 24 protrude from the first part 23 of the mounting frame 21 normally. Each mounting protrusion 24 has a u-shape from which a respective screw pin 26 protrudes in the direction through the window opening 32 of the vehicle body 31.

The armoured inner frame 10 is an independent and separate part of the window construction 1 and it is made of flat bullet resistant sheet steel or in alternative of composite materials such as aramid fibers, glass fibers, carbon fibers or combinations thereof. The inner frame 10 can be an integral frame or a segmented frame comprising overlapping adjoining ends of the segments. The inner frame 10 comprises a plurality of through bores 29 or holes corresponding to the screw pins 27 of the screw connections 25. As shown in FIG. 3 or FIG. 4, the inner frame 10 arranged inside of the vehicle overlaps substantially the whole step 2.7 and pane protrusion 2.6 of the pane means 2 and also an edge area of the inner glass pane 2.3.

The inner frame 10 is fixed to the mounting protrusions 24 on the mounting frame 21 by the screw connections 25 each with screw pin 26 and screw nut 27, wherein in the fixed condition the screw pins 26 extend through the corresponding through bores 29 of the inner frame 10 and the screw nuts 27 are tightened. In the fixed condition, as shown in FIG. 4, the inner frame 10 is supported on an inner surface 45 of the inner glass pane 2.3 by an circumferential adhesive bead 43 and further by circumferential rubber means 41 with a u-shape cross section which supports against the inner surface 45 too and covers an edge of the inner frame (10). The bullet resistant pane means 2 is mounted with its pane protrusion 2.6 of the outer glass pane 2.1 on the window rabbet 35 of the window opening 32 by means of a further circumferential adhesive bead 42 on the outside 34 of the vehicle body 31. More detailed, the first part 23 of the mounting frame 21 is pressed against the lowered window rabbet 35. The outer glass pane is flush to the outside surface 34 of the vehicle body 31.

If a bullet is fired from outside on the weak edge corresponding to the pane protrusion 2.6 of the outer glass pane 2.1 of the bullet resistant glass pane means 2 of the armoured window construction 1 of the invention, it may pass the outer glass pane 2.1, but then the bullet is stopped securely by the armoured and bullet resistant inner frame 10 overlapping the weak protrusion region of the bullet resistant window construction 1. The passengers inside the vehicle or car are, therefore, protected securely by the window construction 1 of the invention.

The invention claimed is:

1. An armoured window construction for a window opening of a body of a vehicle, the armoured window construction comprising:

a bullet resistant pane having an inner glass pane and an outer glass pane, an armoured inner frame arranged inside of the vehicle and overlapping at least part of (i) a peripheral step of the bullet resistant pane or a protrusion of the bullet resistant pane, and (ii) an edge area of the inner glass pane of the bullet resistant pane, and a mounting frame for mounting the inner frame on the bullet resistant pane, wherein the mounting frame is arranged within the peripheral step of the bullet resistant pane, the mounting frame comprises:

a first part fixed on an inner surface of the outer glass pane of the bullet resistant pane within the peripheral step, a second part normal to the first part and fixed on a side face of the bullet resistant pane within the peripheral step, the second part and the first part defining a L-shape cross section of the mounting frame, mounting protrusions protruding from the first part toward the inner frame, and screw pins projecting from the corresponding mounting protrusions further toward the inner frame, the inner frame is removably attached to the mounting protrusions via the screw pins, and the first part of the mounting frame is pressed against a lowered window rabbet on an outside surface of the body of the vehicle.

2. The armoured window construction according to claim 1, wherein the mounting protrusions have respective screw connections each comprising one of the screw pins and a corresponding screw nut, the inner frame comprises a plurality of through bores or holes corresponding to the screw pins of the screw connections, the inner frame is fixed to the mounting protrusions of the mounting frame by the screw connections in a fixed condition in which the screw pins extend through the corresponding through bores or holes of the inner frame and the screw nuts are tightened on the corresponding screw pins, and the screw pins are threaded screw pins.

3. The armoured window construction according to claim 2, wherein each of the mounting protrusions has a U-shape from which the respective screw pin protrudes toward the inner frame.

4. The armoured window construction according to claim 1, wherein the first part is fixed on the inner surface of the outer glass pane within the peripheral step by glue or an adhesive foil.

5. The armoured window construction according to claim 4, wherein the adhesive foil comprises polyurethane.

6. The armoured window construction according to claim 1, wherein the mounting frame is integral or segmented.

7. The armoured window construction according to claim 1, wherein the first part of the mounting frame covers substantially the whole inner surface of the outer glass pane within the peripheral step.

8. The armoured window construction according to claim 1, wherein the mounting protrusions adjoin the first part and the second part at a corner formed by the first part and the second part.

9. The armoured window construction according to claim 8, wherein the mounting protrusions are fixed to the first part and the second part by welding.

10. The armoured window construction according to claim 1, wherein the mounting protrusions are equidistantly arranged along the mounting frame.

11. The armoured window construction according to claim 1, wherein the mounting protrusions protrude perpendicularly from the first part of the mounting frame.

12. The armoured window construction according to claim 1, wherein the armoured inner frame is a flat bullet resistant sheet of steel or plastic or a composite material.

13. The armoured window construction according to claim 12, wherein the armoured inner frame is an independent part of the window construction.

14. The armoured window construction according to claim 1, wherein the inner frame is integral or comprises segments having overlapping adjoining ends.

15. The armoured window construction according to claim 1, wherein the inner frame is supported by at least one of an adhesive bead on an inner surface of an inner glass pane of the bullet resistant pane, and a rubber element which has a U-shape cross section, supports the inner frame against the inner surface of the inner glass pane, and covers an edge of the inner frame.

16. The armoured window construction according to claim 1, wherein at least one of the first part and the second part of the mounting frame is fixed on the corresponding face within the peripheral step by glue or an adhesive foil.

17. The armoured window construction according to claim 16, wherein the adhesive foil comprises polyurethane.

18. The armoured window construction according to claim 1, wherein the armoured inner frame is a flat bullet resistant sheet of a composite material comprising at least one selected from the group consisting of aramid fibers, glass fibers, and carbon fibers.

19. The armoured window construction according to claim 1, wherein each of the mounting protrusions has a U-shape having first and second branches projecting from the first part of the mounting frame toward the inner frame, and a middle portion connecting the first and second branches, and spaced from the first part of the mounting frame, wherein the corresponding screw pin further projects from the middle portion toward the inner frame.

20. The armoured window construction according to claim 1, wherein the inner glass pane defines an innermost pane of the bullet resistance pane, and the mounting protrusions project toward the inner frame and beyond the innermost pane of the bullet resistance pane.

21. The armoured window construction according to claim 1, wherein the armoured inner frame is an independent and separate part of the window construction and the inner frame is free of direct attachment to the body of the vehicle.

* * * * *